US005088264A

United States Patent [19]

Bartkowiak

[11] Patent Number: 5,088,264

[45] Date of Patent: Feb. 18, 1992

[54] YARN THREADING APPARATUS

[75] Inventor: Klaus Bartkowiak, Herne, Fed. Rep. of Germany

[73] Assignee: Barmag AG, Remscheid, Fed. Rep. of Germany

[21] Appl. No.: 551,896

[22] Filed: Jul. 12, 1990

[30] Foreign Application Priority Data

Jul. 13, 1989 [DE] Fed. Rep. of Germany ..... 3923081
Sep. 28, 1989 [DE] Fed. Rep. of Germany ..... 3932306

[51] Int. Cl.[5] ..... D01H 5/28; D01H 15/00

[52] U.S. Cl. ..... 57/280; 57/279; 57/291

[58] Field of Search ..... 57/279, 280, 352, 284, 57/291; 226/97; 28/274, 272

[56] References Cited

U.S. PATENT DOCUMENTS

| | | | |
|---|---|---|---|
| 3,022,566 | 2/1962 | Daniels et al. | 226/97 X |
| 3,559,255 | 2/1971 | Cockroft | 432/59 |
| 3,730,413 | 5/1973 | McDermott et al. | 28/272 |
| 3,930,292 | 1/1976 | Schippers et al. | 28/241 |
| 4,008,560 | 2/1977 | Schnetzer et al. | 57/284 X |
| 4,022,006 | 5/1977 | Howorth | 226/97 X |
| 4,106,892 | 8/1978 | Haga et al. | 432/58 |
| 4,453,298 | 6/1984 | Nabulon et al. | 28/272 X |
| 4,529,378 | 7/1985 | Runkel et al. | 28/272 X |
| 4,809,494 | 3/1989 | Dammann | 57/291 |
| 4,858,809 | 8/1989 | Paulini et al. | 226/97 |

*Primary Examiner*—Daniel P. Stodola
*Assistant Examiner*—John F. Rollins
*Attorney, Agent, or Firm*—Bell, Seltzer, Park & Gibson

[57] ABSTRACT

A yarn threading apparatus is disclosed which is adapted for threading a yarn onto a yarn treatment device, such as the heating and cooling plates of a yarn false twist crimping machine. The threading apparatus comprises an elongate tube having a continuous longitudinal slot extending through the wall thereof, and a plurality of air injection nozzles positioned at longitudinally spaced locations along the length of the tube for forming a helical airstream through the interior of the tube. The yarn may thus be inserted into one end of the tube and entrained in the helical airstream so as to be advanced thereby through the tube and outwardly from the opposite end thereof, and with the helical configuration of the advancing yarn preventing it from withdrawing through the slot. The yarn may thereafter be withdrawn from the tube through the slot and onto the yarn treatment device, by imparting an axial force to the yarn.

15 Claims, 5 Drawing Sheets

YARN THREADING APPARATUS

BACKGROUND OF THE INVENTION

The present invention relates to a yarn threading apparatus adapted for threading a yarn onto a yarn treatment device, such as the heating and cooling plates of a yarn false twist crimping machine.

U.S. Pat. No. 3,930,292 to Schippers et al discloses an apparatus for threading a yarn onto a yarn treatment apparatus which comprises one or more rotatable heated rollers. This known apparatus comprises a tube through which the yarn is initially conveyed by an airstream flowing in the tube, and the tube includes a longitudinal slot which permits the yarn to exit from the tube after it has passed around the rollers. More particularly, the tube is curved and the slot is directed toward the center of the curvature. As a result, this known device is not suitable for threading a yarn onto a stationary yarn guide device, such as for example, the heating and cooling plates of a yarn false twist crimping machine.

It is accordingly an object of the present invention to provide a yarn threading apparatus which offers new uses, which requires little air, and which maintains the yarn safely within the entire tube length during the initial portion of the threading operation.

SUMMARY OF THE PRESENT INVENTION

The above and other objects and advantages of the present invention are achieved in the embodiment illustrated herein by the provision of a yarn threading apparatus which comprises an elongate tube having a continuous slot extending through the wall of the tube and longitudinally along the entire length thereof, and air nozzle means for forming a helical airstream which extends longitudinally through the interior of the tube. By this construction, a yarn is adapted to be inserted into one end of the tube and entrained in the helical airstream so as to be advanced thereby through the tube and outwardly from the opposite end thereof, and the yarn may thereafter be withdrawn from the tube through the slot.

In the preferred embodiment, the air nozzle means comprises a plurality of air injection nozzles positioned at longitudinally spaced locations along the tube, and with the nozzles being directed so that the airstreams therefrom are blown in eccentrically to the tube center and so as to form the desired helical composite airstream through the tube.

One advantage which results from the present invention is that the yarn is conveyed so that its entire length, and not just its leading end, is in the tube, and the frictional forces are minimized to such an extent that the tube can be very long and considerably curved.

In the context of the present invention, the requirement of the flow of air from the nozzles following a course eccentrically of the center of the tube is met provided the center line of an individual air stream, as seen in the longitudinal direction of the tube, is deflected from, or flows laterally of, the center or axis of the tube to an extent that not less than 70% and preferably up to 100% of the individual air stream flows into the interior of the tube along a path laterally displaced from the center. Furthermore, it is necessary that the airstreams impact on the inside wall of the tube with at least one component in the circumferential direction. They are then guided circularly around the tube center along the inside wall of the tube. Consequently, the longitudinal slot should not be opposite to the output directions of the air injection nozzles. The fact that the airstreams impact at least with one component on the inside wall of the tube in the circumferential direction causes them to rotate about the tube center. Due to the additional component in the longitudinal direction of the tube, each airstream produces a helicoidal, i.e., a helical or spiral flow, which continues through the tube. All of the air nozzles produce an air flow in the same direction. The yarn attempts to follow the helicoidal flow and will therefore pass obliquely over the continuous longitudinal slot. This reliably prevents the yarn from exiting from the continuous longitudinal slot.

Should it be desired to provide that one hundred percent of each airstream forms part of the helicoidal flow in the tube interior with a highest possible efficiency, it will be necessary to inject each airstream with its entire cross section eccentrically to the tube center.

In one embodiment of the present invention, the slot includes opposite planar side walls which define respective planes which form secants with the interior of the tube when viewed in transverse cross-section. These planes extend from the slot through the interior of the tube in the direction of rotation of the helical airstream. This construction has the advantage that the yarn rotating about the tube center can pass over the opening of the longitudinal slot, while it rotates, without it being possible that individual filaments of the yarn become entangled on the edges, which the longitudinal slot forms on the inside of the tube. To this end, it is necessary that the secant planes of the tube, as seen from the outside to the inside, point in the direction of rotation of the airstream.

The nozzles may be positioned exteriorly of the slot so that the airstreams therefrom advance through the slot and then into the interior of the tube. The walls of the longitudinal slot thus form a guide channel for each entering airstream. The thickness of the wall preferably corresponds to the length of the channel. An advantage of this construction is that the yarn is raised from the inside wall of the tube as it passes over the slot, so that the individual yarn filaments are unable to become entangled in the slot.

In a further embodiment, the slot includes opposite side wall portions which communicate with the interior of the tube, with one of the side wall portions lying in a plane which is tangent to the periphery of the interior of the tube. This construction results in a low-loss air flow, in which the airstreams contact the inside wall of the tube substantially without impact so that they are caused to rotate about the tube center without a counterflow.

In still another embodiment, the tube further includes a plurality of longitudinally spaced-apart exhaust openings extending through the wall of the tube on the side thereof generally opposite from the air injection nozzles. This construction permits the length of the threading tube to be considerably extended without adversely effecting the operating reliability and without increasing the consumption of compressed air. Without this measure and at the same tension the air requirement is up to approximately six times as much. Further, this measure permits the yarn to be caught and sucked in at any point along the longitudinal slot.

The exhaust openings may include exterior slots which communicate with the exterior of the tube and extend transversely to the longitudinal direction. This feature permits the tube to be manufactured at a favorable cost. The slots may alternatively extend obliquely to the axis of the tube, and such that they cross the yarn passing thereover at about a right angle.

The tube may be formed of an extruded material which has the advantage that burrs resulting from the cutting of the exhaust air holes or respectively the transverse slots cannot extend into the interior of the tube. To this end, recesses may be positioned in the inside wall of the tube, which extend along the tube axis and proceed from the inside wall of the tube. When cutting the exhaust holes or transverse slots, for example, by sawing, drilling, milling or the like, such holes or slots terminate in the recesses rather than in the inside wall of the tube. Thus, possible burrs resulting from the cutting will not be formed in the interior of the tube and which could hinder the advancing yarn. Another advantage of extruding the tube is that the interior of the tube need not be reworked. Also, extrusion of the tube is particularly suitable for a low-cost manufacture of very long yarn threading devices. In this case it is useful to arrange the recesses over the entire tube length, so that, for the sake of simplicity, they are formed along with the manufacture of the extrusion profile.

The present invention is particularly adapted for use with a yarn false twist crimping machine of the type disclosed in U.S. Pat. No. 4,809,494 to Dammann, and which comprises an elongate yarn heating plate, an elongate yarn cooling plate, yarn false twisting means, and means for advancing a yarn serially along the heating plate and the cooling plate and through the false twisting means. In this case, the yarn threading device serves to place a yarn on the heating plate and/or the cooling plate. The threading device is especially advantageous in the instance, in which both the heating plate and the cooling plate form an arched, convex threadline. Also, in this instance, the yarn advances on the convex side of the heating plate and cooling plate and extends, for example, in the form of a parabola, over the heating-cooling zone arranged in the shape of a cupola, in any event, however, in a curved path from the top, thereby enabling a simple threading of the yarn. It should be expressly noted that the threading device is also suitable for threading the yarn on the heating plate alone or only on the cooling plate.

A further aspect of the present invention combines the advantages of a tube which is simple to bend free of kinks, and of an adequate supply of compressed air even in the case of very great tube lengths. To this end, it is preferred that the cross section of the tube be substantially symmetrical with respect to a plane which includes the tube center and is perpendicular to the axis of the bend, so that the yarn threading tube will not move sideways when being bent. On both sides of the perpendicular plane, it is necessary to arrange substantially identical air passageways, of which one is used only to supply compressed air to the compressed air channel which supplies the compressed-air nozzles. Suitably, the compressed air is supplied through evenly spaced-apart connecting lines.

The tube may include a reduced cross-section adjacent the entry end thereof so as to define an internal shoulder which faces downstream in the longitudinal direction, and an air nozzle communicating with the shoulder so as to direct an air-stream longitudinally into the interior of the tube and toward opposite or discharge end thereof. This configuration makes it possible to suck in a yarn in the inlet zone of the tube, also from great distances, by lowering the pressure therein.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
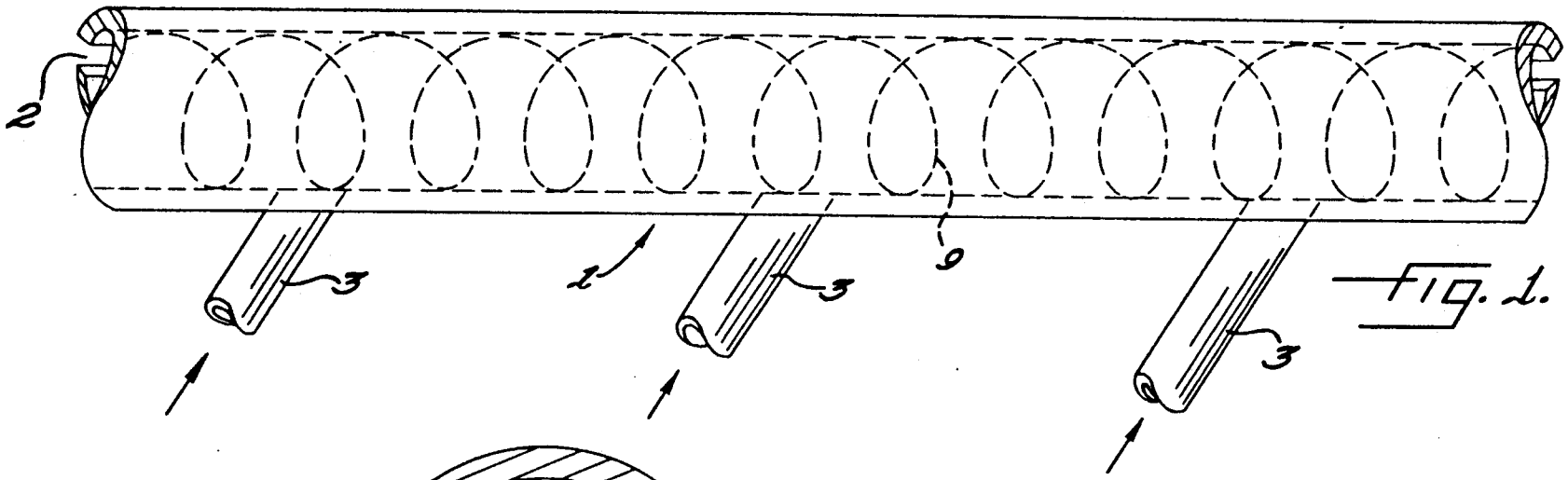
FIG. 1 is a fragmentary side elevation view of a yarn threading apparatus which embodies the features of the present invention.
Figure 1A:
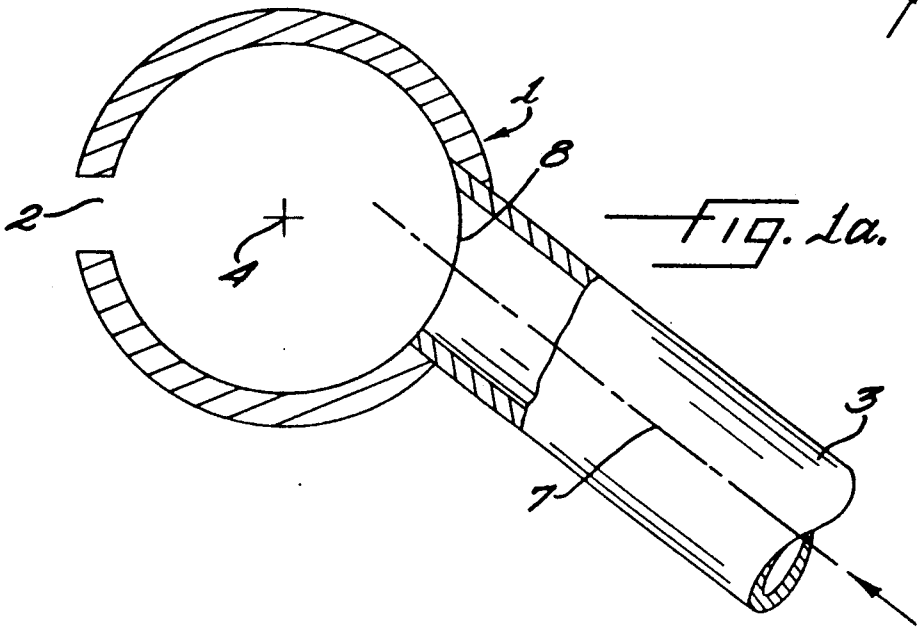
FIG. 1*a* is a cross-sectional view of the apparatus shown in FIG. 1.

Referring more particularly to the drawings, FIGS. 1–4 illustrate several embodiments of a yarn threading apparatus in accordance with the present invention, with each embodiment comprising, a substantially straight tube 1. Each illustrated tube is a section of a yarn threading tube, which extends over a certain threading length. Between the beginning and end of the tube section, a continuous longitudinal slot 2 extends along a surface line of the tube, which fully penetrates through the tube wall. In the embodiment of FIGS. 1 and 1*a*, several compressed air nozzles 3, one succeeding the other with a spacing therebetween, extend in the axial direction of the tube, with the spacing between the successive tubes being identical. The compressed air nozzles are inclined toward the tube axis, so that they each deliver an airstream into the interior of the tube with a component in the longitudinal direction of the tube. Also, all of the compressed air nozzles terminate at the interior of the tube and are parallel to each other.

As can be noted from the cross sectional view of FIG. 1*a*, each compressed air nozzle 3 is positioned opposite to the longitudinal slot 2, but its opening is directed past the tube center 4, when viewed in the direction of the center line 7. The zone of impact of the airstream thus lies directly on the opposite tube wall outside the range of the longitudinal slot opening in the tube wall.

Figure 2:
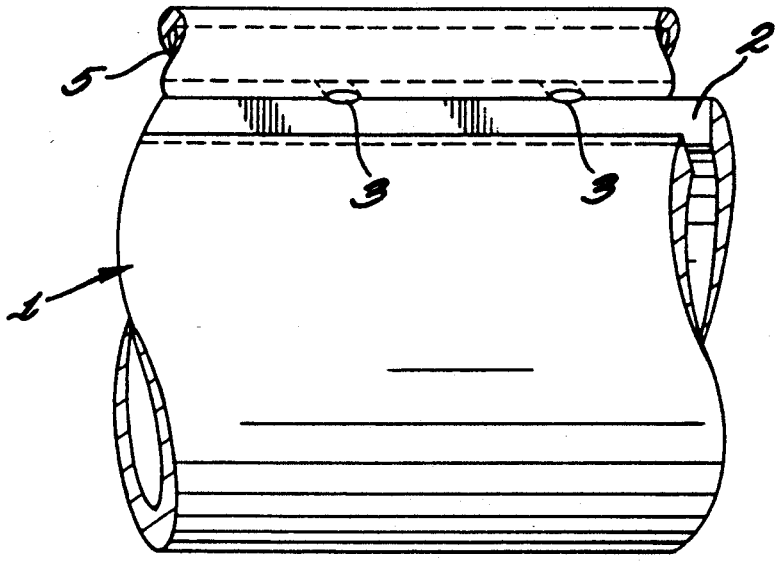
FIG. 2 is a fragmentary side elevation view of another embodiment of the present invention.
Figure 2A:
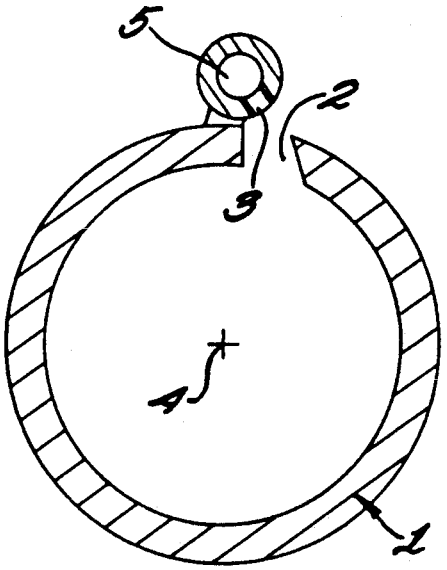
FIG. 2*a* is a cross-sectional view of the embodiment shown in FIG. 2.
Figure 3:
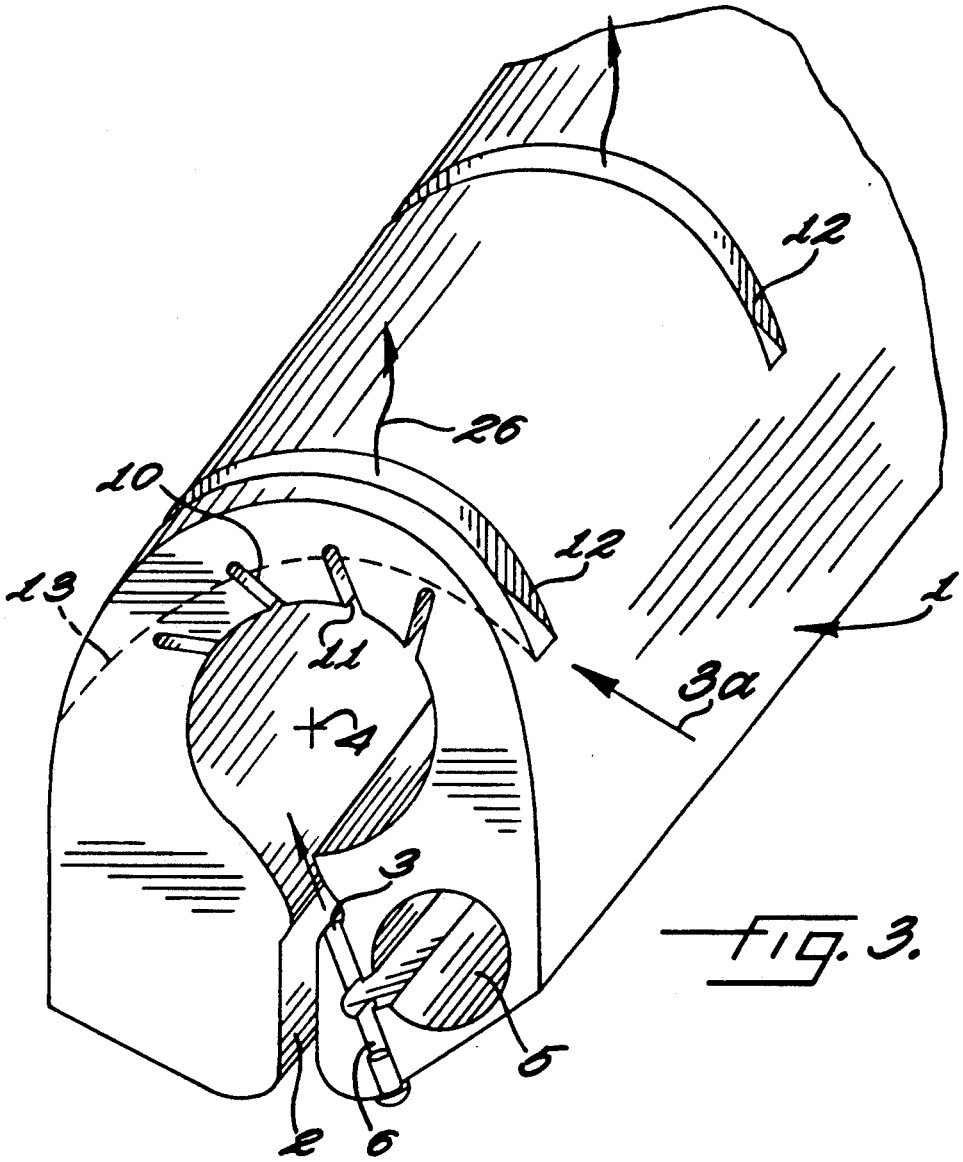
FIG. 3 is a fragmentary perspective view of a further embodiment of the present invention.
Figure 4:
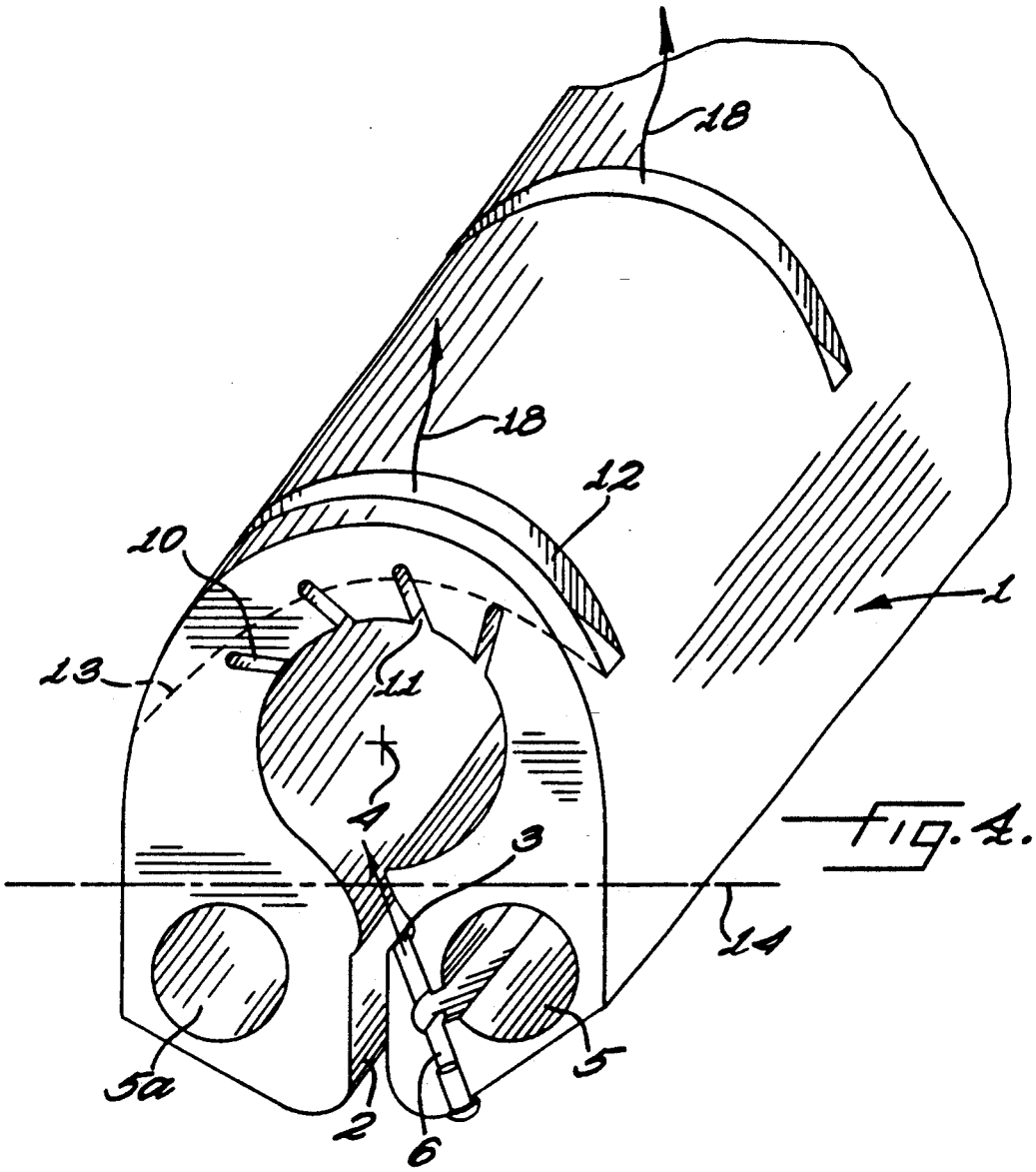
FIG. 4 is a view similar to FIG. 3 and illustrating still another embodiment of the invention.

In contrast thereto, the embodiments of FIGS. 2–4 differ in that each compressed air nozzle terminates on the outside of the longitudinal slot 2, and the longitudinal slot is defined by two planes which extend through the tube wall as a secant, i.e. they are not directed to the tube center. The central point of the tube is indicated at 4 and is also referred to as the tube center.

In the embodiment of FIG. 1*a*, the longitudinal slot is arranged in such a manner that it points radially in the direction of the tube center 4.

Another difference, which exists between FIGS. 1 and 1*a* and respectively FIGS. 2–4, is that the compressed air nozzles of FIG. 1 comprise individual nozzle connections, which are arranged independently of and spaced apart from each other along the tube axis. In the case of FIGS. 2–4, these compressed air nozzles comprise tap holes, which branch off from a compressed air line 5 extending along the tube 1. In the case of FIG. 2, the compressed air line 5 is a conduit arranged on the outside of the yarn tube, whereas in the case of FIGS. 3 and 4, the compressed air line is a recess formed within the full cross section of the yarn tube. This recess is tapped via a bore 6, which terminates in that region of the longitudinal slot 2 at which the longitudinal slot merges with the inside diameter of the tube.

As can be seen in FIG. 1*a*, the center line 7 of each individual compressed air nozzle 3 extends eccentrically to the tube center 4 in such a manner that almost the entire flow which enters from the outlet opening 8 of the nozzle into the interior of the tube, is blown past the tube center. In the illustrated case, the distance between the center line 7 and the tube center 4 amounts to approximately half the tube diameter. Thus, the entire airstream exiting from the opening 8 is blown substantially entirely past the tube center and impacts with a component in the circumferential direction on the opposite inside wall of the tube and is deflected by the same. The longitudinal slot should not be positioned in the impact zone of the airstream, since the injected air current would immediately escape again through the longitudinal slot. Due to the deflection of the injected airstream on the inside wall of the tube, the. flow is forced into a circular path about the tube center 4. Since an axial component is additionally imparted upon the flow, the rotating flow also continues in the axial direction of the tube. This results in a helical flow 9, which is shown in FIG. 1. This illustration applies to all Figures.

The flow thus forms a helix, which is defined by the two directional components of the injected current directions. It is, for example, possible to obtain a helical flow with a greater pitch, in that the airstream is injected with a greater component in the axial direction of the tube. A yarn inserted into the longitudinal slot will always attempt to follow the helically continuing flow lines of the airstream and, consequently, will never be directed exclusively in the axial direction of the tube. As a result of the helix, the yarn will always pass obliquely over the longitudinal slot, so that it is safely prevented from sliding out piecemeal.

In the embodiments of FIGS. 2–4, the air is injected from the outside into the longitudinal slot 2 of the yarn tube, i.e., the airstream exiting from each nozzle 3 is injected from the outside into the longitudinal slot. Depending on the geometry of the longitudinal slot, in particular both its width and depth, it is possible to guide the airstream leaving the nozzle 3 from both walls defining the slot into the interior of the tube. If, in comparison with the cross section of the nozzle, the longitudinal slot is made narrow enough, the injected airstream will be closely adjacent to the walls of the longitudinal slot. This permits the entering airstream to be additionally guided.

Another special feature is shown in FIGS. 3 and 4. Here, the longitudinal slot 2 is connected with the interior of the tube in such a manner that one of its boundary walls is tangential to the inner periphery of the tube. This boundary wall is the tangential plane to the inside wall of the tube. Both boundary walls are secant planes of the tube, of which one assumes an extreme position, namely a tangential position.

Yet another special feature of FIGS. 3 and 4 includes the recesses 10, which extend in the longitudinal direction of the tube and communicate with the inside wall of the tube. To this end, each recess is provided with an opening 11, which connects the recess 10 with the inside wall of the tube. The recesses extend essentially radially away from the inside wall of the tube in the solid cross section of the profile. The recesses are positioned opposite to the inlet side of the compressed air, which is provided by the arrangement of the longitudinal slot. They are inclined in the intended rotational direction of the airstream which is illustrated as being clockwise, so that the air flow will always pass over the opening 11. The yarn or its filaments, which are entrained in the airstream, will therefore be unable to become entangled on the edges between the recesses and the inside wall of the tube.

A still further special feature of FIGS. 3 and 4 is the radial slots 12, which are cut into the profile from the outside and extend transversely to the tube axis. The radial slots are recesses which are provided in the solid cross section of the profile and evenly spaced apart. The radial depth 13 of these radial slots is illustrated by the dashed line, and as can be clearly seen, the radial depth terminates in the recesses 10, so that the radial slots 12 are not directly connected with the interior of the threading tube. When cutting the radial slots into the solid cross section of the profile, any resulting burrs will not terminate in the interior of the tube, but in the recesses. However, these recesses are not contacted by the yarn to be advanced and, consequently, need not be reworked after having cut the radial slots.

Figure 3A:
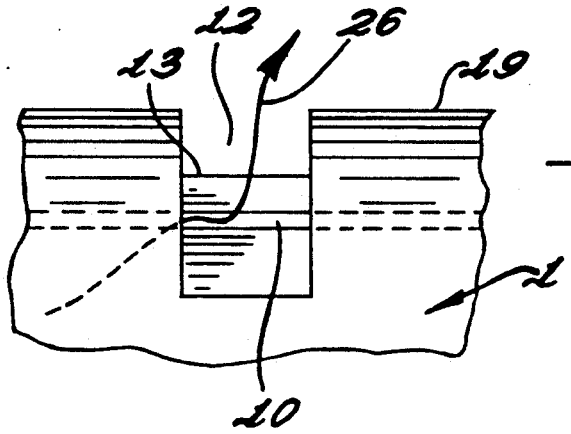
FIG. 3*a* is a fragmentary view of a portion of the apparatus shown in FIG. 3, and taken in the direction of the arrow 3*a* in FIG. 3.

FIG. 3*a* is a fragmentary side elevation view of a portion of the yarn threading tube 1. The radial slot 12 is a cut extending transversely in the surface 19 of the yarn tube 1. This cut is axially crossed by the recess 10 such that the recess forms a slot-shaped opening into the surroundings. From this slot-shaped opening, which extends along the tube axis over the entire width of the radial slot 12, the exhaust air 26 leaving the interior of the tube exits into the open surroundings.

Thus, a continuous connection is created between the interior of the yarn tube and the open surroundings via the recesses 10 and radial slots 12. A certain number of such radial slots is arranged between two successive compressed air nozzles. The compressed air, which is supplied via the nozzles to the interior of the tube, will in part escape again as exhaust air 26 from the radial slots as it travels from one nozzle to the next. In this manner, it is avoided that the compressed air must leave the interior of the tube through the longitudinal slot 2 before it reaches the next compressed air nozzle.

Another special feature of the invention as illustrated in FIG. 4 is the profiled cross section, which is substantially symmetrical with respect to a plane which includes the tube center 4 and is perpendicular to a bending axis 14. To obtain this symmetry, the profile is provided with a channel 5*a* which is symmetric to the compressed air channel 5, and which is formed as a blind channel with the same cross section as the channel 5, but which is not used for the injection of air. This has the advantage that when the tube is bent about the axis 14, the profile will be unable to deform asymmetrically with regard to the perpendicular plane.

Figure 4A:
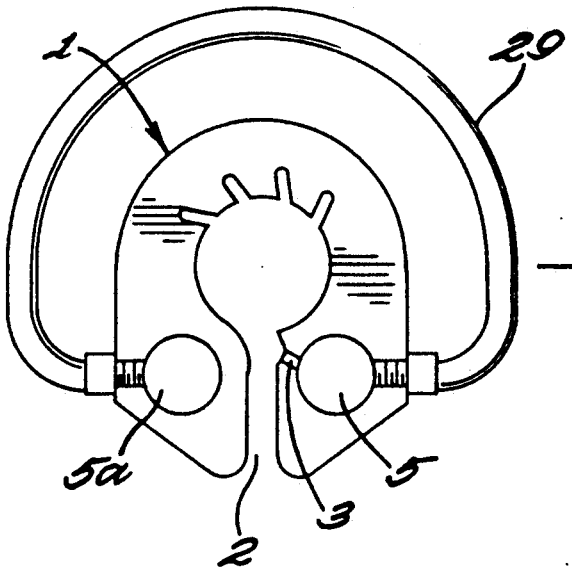
FIG. 4*a* is an end view of the tube shown in FIG. 4 and further illustrating the interconnection between the illustrated air channels.

In the further embodiment of FIG. 4*a*, the channel 5*a* is used to convey the air current for the nozzles 3. To inject the air flowing in channel 5*a* into the compressed air channel 5, connecting lines 29 are used, which extend from the blind channel 5*a* to the compressed air channel 5. As illustrate, the lines 29 are placed around the portion of the tube circumference which faces away from the slot 2.

Figure 5:
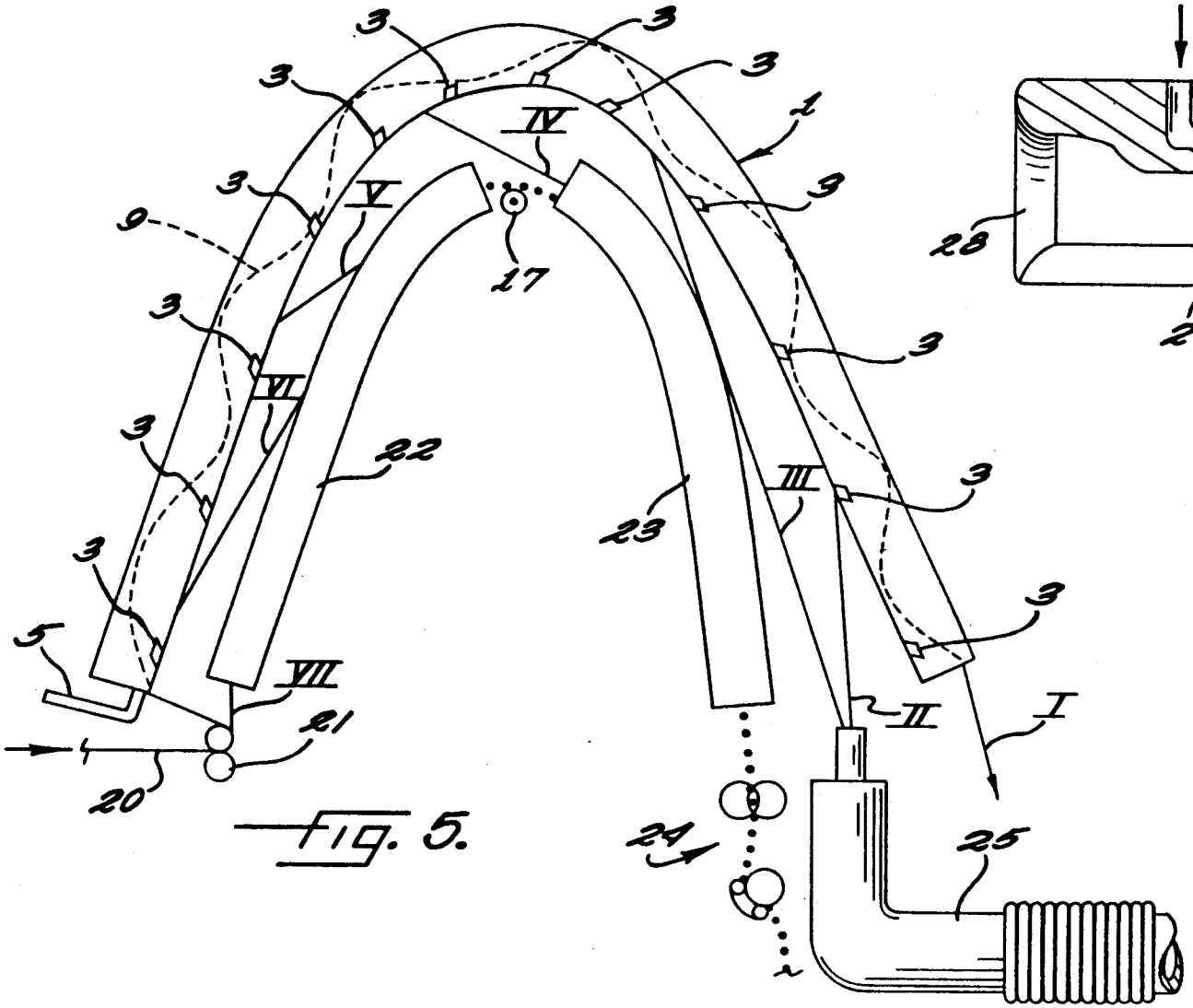
FIG. 5 is a schematic side elevation view of a portion of a yarn false twist crimping machine which embodies the present invention.

FIG. 5 shows a yarn threading tube 1 used in association with the heating-cooling zone of a false twist crimping machine. Such a false twist crimping machine is disclosed, for example, in U.S. Pat. No. 4,809,494, the disclosure of which is expressly incorporated herein by reference. As illustrated in FIG. 5, the yarn 20 advances first over a pair of feed rolls 21 and then into the inlet opening of the yarn threading tube 1. As is indicated, once the yarn is inside the tube, it will assume a helical configuration 9, with which it follows the helical flow of the airstream. After the yarn has exited from the outlet of the threading tube (position I), it can be threaded onto the heating-cooling zone, which comprises a heating plate 22 and a cooling plate 23, and which are convexly curved in the upward direction. The heating plate 22 forms with the cooling plate 23 a parabolic, downwardly open unit, which is open in the region of the apex of the parabola, i.e. in the upper area. There, a guide roll 17 is provided for the yarn. In its threaded condition, the yarn 20 advances over the pair of feed rolls 21 into the inlet end of the heating plate 22 (position VII). It then advances upwardly over the heating plate, and at the apex of the parabola it advances to the cooling plate. Subsequently it moves downwardly over the cooling plate and is supplied to further processing unit, such as a conventional friction false twisting device 24, after leaving the cooling plate.

The yarn is threaded onto the machine as follows. The yarn which is at position I and leaving the threading tube, is taken up, for example, by a suitable transferring device, which may be a yarn suction gun 25, and is pulled out of the outlet end of the threading tube along the slot (position II). While the yarn is pulled out, the exit end of the yarn moves along the slot in the direction toward the inlet end of the threading tube. In so doing, the yarn passes through the positions III to VI. The further the yarn is pulled out of the longitudinal slot, the longer becomes its length which is threaded onto the heating-cooling zone. Thus the threading starts at the outlet end of the cooling plate 23 and continues to the inlet end of the heating plate 22. After the yarn is thus removed from the threading tube, it advances in the illustrated position VII in an orderly fashion to the inlet end of the heating plate 22.

One special feature of the illustrated threading tube includes compressed air nozzles 3, one succeeding the other in the direction of conveyance, and which are less spaced apart from each other in the region of the apex of the parabola, i.e., where the threading tube is most bent, than they are in the inlet and outlet zones of the threading tube. However, such an arrangement is not absolutely necessary, but it is desirable from the additional requirement that the threading tube exert a greatest possible effect on the yarn with the lowest possible air requirement. This requirement is a possible criterion of optimization for the effectiveness of the threading tube in the region of sharp curvatures, which, however, does not influence the basic function of the threading tube.

Figure 6:
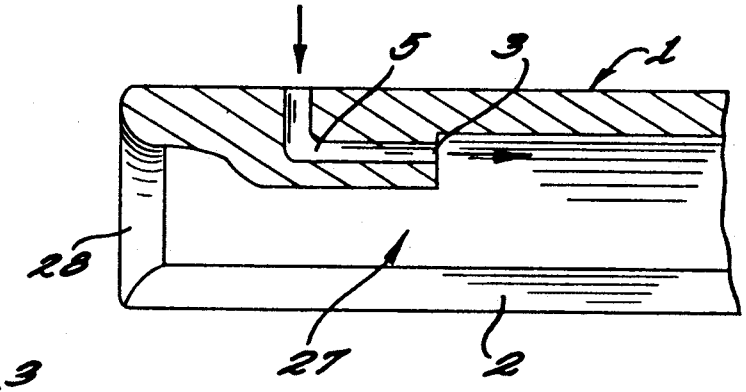
FIG. 6 is a sectioned side elevation view of the entry end of one embodiment of the tube of the present invention.

FIG. 6 illustrates the inlet portion of a yarn threading tube 1, whose inside cross section is reduced at 27. The reduced cross sectional portion comprises a thickened portion of the inside wall of the tube, which faces the interior of the tube. This thickened portion fills in part the interior of the tube so that the remaining open cross section is smaller than the cross section of the remainder of the tube. The inlet end 28 of the tube is rounded for the protection of the yarn, so that an entering yarn can pass unhindered over the inlet end. Shortly after the yarn inlet end, the thickened portion 27 follows in such a manner that the entering yarn is always guided over the rounded steps, edges or the like. Facing away from the yarn inlet side, the thickened portion forms a shoulder with the inside wall of the tube, from whence the inside wall of the tube starts to have a larger cross section which extends to the other tube end. This shoulder forms a front surface, which faces in the downstream direction of the yarn threading tube. A compressed air channel 5 with a nozzle-like opening 3 terminates in this front surface, i.e. directly at the end of the reduced cross section. Both the entering and the exiting air currents of the channel 5 are indicated by arrows. The air current exits from the nozzle opening 3 in the region of the yarn threading tube, where the latter has again its larger diameter. Depending on the type of injector nozzle, the exiting jet is to carry along the air particles which surround it, and to thus generate a flow in the inlet portion of the yarn threading tube with the reduced cross section, which is sucked in from the surroundings and leads to a lower pressure at the inlet end of the tube due to its high velocity. The lowering of the pressure results in that a yarn, which is outside the tube inlet, but in its vicinity, is sucked in especially strongly, thereby improving the sucking function of the yarn threading tube at its inlet end.

In the drawings and specification, there has been set forth a preferred embodiment of the invention, and although specific terms are employed, they are used in a generic and descriptive sense only and not for purposes of limitation.

That which is claimed is:

1. An apparatus for threading yarn onto a yarn treatment device, comprising:

means defining an elongate open-ended tube having a substantially circular interior surface and a slot extending through a wall substantially along the entire length thereof, and nozzle means disposed to direct air into said tube in a direction laterally offset from the longitudinal axis thereof and having a component for forming a substantially helical flow along the interior of said tube, whereby a yarn inserted into one end of said tube may be entrained in the helical flow to be advanced through said tube to the opposite end thereof for subsequent withdrawal from the tube through said slot.

2. The yarn threading apparatus as defined in claim 1 wherein said nozzle means comprises a plurality of air injection nozzles positioned at longitudinally spaced locations along said tube, each nozzle being directed so that the resulting flow of air has a component which forms a secant with or is tangent to the interior surface of said tube.

3. The yarn threading apparatus as defined in claim 2 wherein said slot includes opposite planar side walls which define respective planes which form secants with the interior of the tube, said planes extending from said slot through the interior of said tube in the direction of rotation of the helical flow of air.

4. The yarn threading apparatus as defined in claim 3 wherein said nozzles are positioned exteriorly of said slot so that the flow of air from said nozzles advances through said slot into the interior of said tube.

5. The yarn threading apparatus as defined in claim 3 wherein the width of said slot is less than the radius of the interior of said tube.

6. The yarn threading apparatus as defined in claim 2 wherein said slot includes opposite side wall portions which communicate with the interior of said tube, with one of said side wall portions lying in a plane tangent to the periphery of the interior surface of said tube.

7. The yarn threading apparatus as defined in claim 1 wherein said tube is arcuately curved along its length, said tube being substantially symmetrical with respect to a plane which includes the center of said tube and is perpendicular to the axis of curvature.

8. The yarn threading apparatus as defined in claim 1 wherein said tube has a reduced cross section adjacent said one end thereof so as to define an internal shoulder, said nozzle means communicating with said shoulder to direct said flow of air into the interior of said tube toward said opposite end thereof.

9. An apparatus for threading yarn onto a yarn treatment device, comprising:

means defining an elongate open-ended tube having a substantially circular interior surface including a plurality of exhaust openings longitudinally spaced apart and extending through the wall of the tube and a slot extending through said wall substantially along the entire length thereof, and nozzle means disposed to direct air into said tube in a direction laterally offset from the longitudinal axis thereof and having a component for forming a substantially helical flow along the interior of said tube, said nozzle means being positioned substantially opposite said exhaust openings, whereby a yarn inserted into one end of said tube may be entrained in the helical flow to be advanced through said tube to the opposite end thereof for subsequent withdrawal from the tube through said slot.

10. The yarn threading apparatus as defined in claim 9 wherein said exhaust openings include exterior slots which communicate with the exterior of said tube and extend generally transversely of the longitudinal direction of said tube.

11. The yarn threading apparatus as defined in claim 10 wherein said exhaust openings further include elongate recesses in the peripheral surface of the interior of said tube and which communicate with said exterior slots.

12. The yarn threading apparatus as defined in claim 9 wherein said tube is formed of an extruded material, and said recesses extend along the entire length of said tube.

13. A yarn false twist crimping machine for processing synthetic yarn comprising:

elongate yarn heating plate means, elongate yarn cooling plate means, yarn false twisting means, means for advancing a yarn serially along said heating plate means and said cooling plate means and through said false twisting means, and means for threading a yarn into an operative position extending along at least one of said heating plate means and said cooling plate means, comprising: an elongate tube positioned so as to extend along the entire length of said one plate and having a continuous slot extending through the wall of said tube and longitudinally along the entire length thereof, and air nozzle means for forming a helical airstream which extends longitudinally through the interior of said tube, whereby a yarn is adapted to be inserted into one end of said tube and entrained in the helical airstream so as to be advanced thereby through said tube and outwardly from the opposite end thereof, and the yarn may thereafter be withdrawn from the tube through said slot and so as to be positioned along said one plate.

14. A yarn false twist crimping machine for processing synthetic yarn comprising:

elongate yarn heating plate means, elongate yarn cooling plate means, yarn false twisting means, means for advancing a yarn serially along said heating plate means and said cooling plate means and through said false twisting means, and means for threading a yarn into an operative position extending along said heating plate means and said cooling plate means, comprising: an elongate tube positioned so as to extend along the entire length of said heating plate and said cooling plate and having a continuous slot extending through the wall of said tube and longitudinally along the entire length thereof, and air nozzle means for forming a helical airstream which extends longitudinally through the interior of said tube, whereby a yarn is adapted to be inserted into one end of said tube and entrained in the helical airstream so as to be advanced thereby through said tube and outwardly from the opposite end thereof, and the yarn may thereafter be withdrawn from the tube through said slot and so as to be positioned along said heating plate and said cooling plate.

15. The yarn false twisting machine as defined in claim 14 wherein said heating late means and said cooling plate means are arranged in the general configuration of a cupola and are convexly curved toward the outside, said elongate tube of said threading means being arcuately curved and positioned above said heating plate means and said cooling plate means.

* * * * *